US005247271A

United States Patent [19]

Kawamura et al.

[11] Patent Number: 5,247,271

[45] Date of Patent: Sep. 21, 1993

[54] SUPERCONDUCTING SOLENOID COIL

[75] Inventors: Toshimi Kawamura, Suita; Masao Morita, Itami, both of Japan

[73] Assignee: Mitsubishi Denki Kabushiki Kaisha, Tokyo, Japan

[21] Appl. No.: 13,667

[22] Filed: Jan. 28, 1993

Related U.S. Application Data

[63] Continuation of Ser. No. 854,797, Mar. 23, 1992, which is a continuation of Ser. No. 581,264, Sep. 11, 1990, abandoned, which is a continuation of Ser. No. 773,360, Sep. 6, 1985, abandoned.

[30] Foreign Application Priority Data

Sep. 7, 1984 [JP] Japan ..... 59-188407

[51] Int. Cl.[5] ..... H01F 7/00

[52] U.S. Cl. ..... 335/216

[58] Field of Search ..... 335/216, 299; 174/125.1; 336/DIG. 1; 505/705, 879, 880

[56] References Cited

U.S. PATENT DOCUMENTS

| | | | |
|---|---|---|---|
| 3,360,692 | 12/1967 | Kafka | 335/216 X |
| 3,432,783 | 3/1969 | Britton et al. | 335/216 |
| 3,440,585 | 4/1969 | Freeman | 335/216 |
| 3,559,130 | 1/1971 | Schrader | 335/216 |
| 3,913,044 | 10/1975 | Albrecht et al. | 335/216 |

FOREIGN PATENT DOCUMENTS

| | | |
|---|---|---|
| 1964605 | 6/1971 | Fed. Rep. of Germany . |
| 1439452 | 6/1973 | Fed. Rep. of Germany . |
| 0011603 | 1/1984 | Japan . |
| 0079505 | 5/1984 | Japan . |

OTHER PUBLICATIONS

W. Buckel, "Supraleitung—Grundlagen und Anwendungen" [Superconduction—Fundamentals and Applications], 2nd ed. 1977, Physik-Verlag Weinheim, Capter 7.2, Critical Currents in Hard Superconductors, pp. 172–180.

"Proceedings of the COMPUMAG Conference on the Computation of Magnetic Fields", No. 28, Chilton, Didcot, Oxon, UK, 1976, pp. 138–143.

Willig et al, "Thin-Walled Solenoid End Effects", IEEE Transactions on Magnetics, vol. MAG-13, No. 5, Sep. 1977, pp. 1122–1124.

Hirabayashi et al, "Measurement of Propagation Velocities . . . ", Japanese Journal of Applied Physics, vol. 20, No. 11, Nov. 1981, pp. 2243–2249.

"Large Superconducting Detector Magnets With Ultra Thin Coils For Use In High Energy Accelerators and Storage Tings", M. A. Green, University of California.

*Primary Examiner*—Leo P. Picard
*Assistant Examiner*—Raymond M. Barrera
*Attorney, Agent, or Firm*—Leydig, Voit & Mayer

[57] ABSTRACT

A superconducting apparatus including a superconducting solenoid coil made of a superconducting wire wound around a bobbin. The superconducting wire has a superconductor having a rectangular cross-section of a narrow width, and the superconductor of the superconducting wire has a larger sectional area at the end region of the superconducting solenoid coil than at the central region. The superconductor at the end region of the superconducting solenoid coil may comprise a plurality of superconducting wires with superconductors having a large sectional area, or may comprise a plurality of superconductors connected in parallel to each other, thereby increasing the effective sectional area of the superconductor in the end region.

6 Claims, 1 Drawing Sheet

SUPERCONDUCTING SOLENOID COIL

This application is a continuation of application Ser. No. 07/854,797, filed Mar. 23, 1992, which is a continuation of application Ser. No. 07/581,264, filed Sep. 11, 1990, now abandoned, which is a continuation of application Ser. No. 06/773,360, filed Sep. 6, 1985, now abandoned.

BACKGROUND OF THE INVENTION

This invention relates to a superconducting apparatus having a superconducting solenoid coil comprising a thin coil wound around a bobbin, and particularly to means for suppressing local increases in the magnetic field in the end region of the superconducting solenoid coil.

FIGS. 1 and 2 illustrate a conventional apparatus of this type. In the figures, a superconducting solenoid coil 1 is wound into the form of a cylinder by winding a superconducting wire 4 around a cylindrical bobbin 5. The superconducting wire 4 comprises a superconductor 2 embedded within a stabilizing material 3. The superconductor 2 has a rectangular cross section with a thickness which is much less than its width. The superconducting solenoid coil 1 is housed within a cryostat 6.

The operation of this conventional apparatus is as follows. The cylindrical thin superconducting solenoid 1 having a coil thickness which is small compared to its diameter is utilized in a particle colliding apparatus for studying elemental particles of high kinetic energy as discussed in the article "CONSTRUCTION AND TEST OF THE CELLO THIN-WALL SOLENOID" (1980, Adv. Cryog. Eng. 25, p.175–p.184). The coil is made as thin as possible to make it more transparent to elemental particles. The materials used for constructing the apparatus are based mainly on aluminum and carbon, except for the superconductor 2, taking better transparency to particles into consideration. As a matter of course, an extremely high current density is used in order not to unnecessarily increase the sectional area of the superconductor 2. During the operation of the superconducting solenoid coil 1, current flows only through the superconductor 2 of the superconducting wire 4 and usually does not flow through the stabilizing material 3. The current flows through the stabilizing material 3 when the superconducting state is destroyed and the current bypasses to promote a return to a superconducting state as described in "Institute of the Electrical Engineering Collegiate Lectures; Superconducting Engineering" (1974, Japanese IEEE, P.60–P.65). Thus, since the superconductor 2 has a very small cross sectional area compared to the diameter of the coil 1, a very strong magnetic field is generated at the end portions of the superconducting solenoid coil 1. This is one kind of an end effect and a similar phenomenon is discussed in "Electromagnetic Phenomenon Theory" (S. Maruyama, Maruzen Press, 1944, p. 184) The electric field strength $\sigma$ at the end portion of a semi-infinite plane is expressed by $$-\epsilon\left(\frac{\partial v}{\partial y}\right)_{y=0},$$

which equals $$-\frac{\epsilon A}{2}\ \frac{1}{\sqrt{x}}.$$

Accordingly, when $x=0$, $\sigma=-\infty$. When the thickness is infinitely small, the magnetic field at the end portion of the superconducting solenoid coil 1 becomes infinitely large. While the magnitude of this magnetic field generally has an upper limit due to the finite thickness of the coil, it nevertheless reaches a significantly high value.

Since the conventional superconducting apparatus is constructed as above described, an increase in the magnetic field at the end portions of the superconducting solenoid coil is inevitable, which sometimes makes superconductivity impossible since the upper limit of the current depends upon the strength of the magnetic field experienced. More particularly, even when sufficient stabilization is provided in terms of maintaining the superconducting phenomenon, once partial destruction of the superconductivity occurs, the destruction spreads in a chain-reaction. Therefore a reliable counter measure is necessary for a large, high energy experimental apparatus such as that described above.

SUMMARY OF THE INVENTION

This invention has been made to eliminate the drawbacks of the above described conventional design and has as its object the provision of a superconducting apparatus in which an increase in the magnetic field is prevented and in which the superconductivity is highly reliably maintained by constructing a superconductor of a superconducting wire so as to have a larger sectional area at the end region of the superconducting solenoid coil than at the central region, thereby lowering the current density at the end region.

BRIEF DESCRIPTION OF THE DRAWINGS

The present invention will become more readily apparent from the following detailed description of the preferred embodiments of the invention considered in conjunction with the accompanying drawings, in which.

In the figures, the same reference numerals designate identical or corresponding components.

DESCRIPTION OF THE PREFERRED EMBODIMENTS

Figure 1:
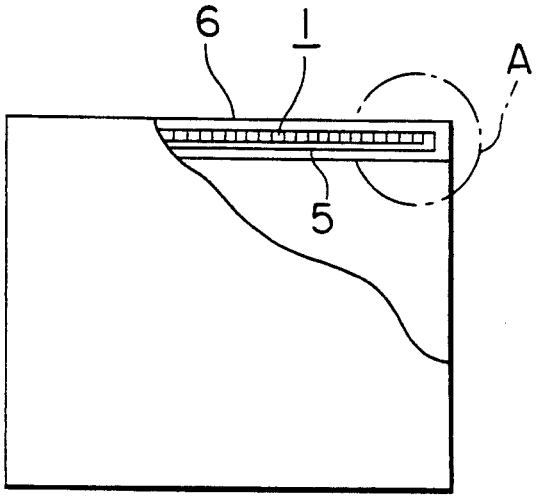
FIG. 1 PRIOR ART
FIG. 1 is a sectional side view of a conventional superconducting apparatus.
Figure 2:
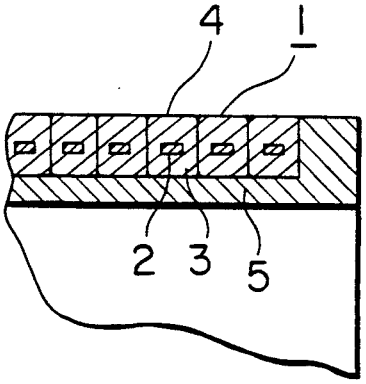
FIG. 2 PRIOR ART
FIG. 2 is an enlarged sectional side view of Region A shown in FIG. 1.
Figure 3:
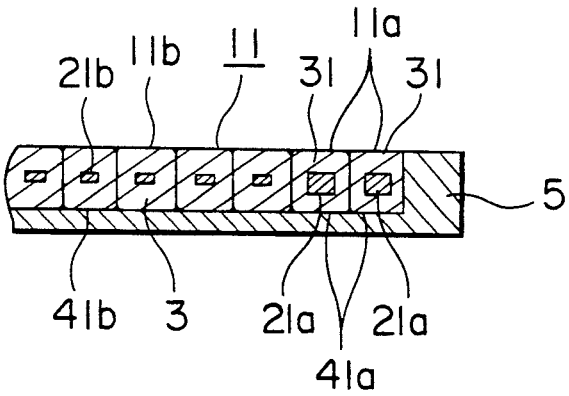
FIG. 3 is an enlarged sectional side view of the main portion of one embodiment of a superconducting apparatus of the present invention.

One embodiment of the present invention will now be described while referring to FIGS. 3 through 5. In FIG. 3, a superconducting solenoid coil 11 wound on a bobbin 5 includes an end region 11*a* and a central region 11*b*, an insulated superconducting wire 41*a* having two turns, for example, in the end region which is composed of a superconductor 21*a* embedded in a stabilizing material 31, and an insulated superconducting wire 41*b* in the central region composed of a superconductor 21*b* embedded within the stabilizing material 31. The superconductor 21*a* in the end region is constructed so that its cross-sectional area is larger than the cross sectional area of the superconductor 21*b* in the central region, thereby reducing the current density in the superconducting wire 41*a* in the end region.

Since the current density is decreased in inverse proportion to the increase in the cross sectional area, a sufficient margin is provided within the superconductivity limit for a superconductor of the same superconductivity. Furthermore, the fact that the current density is low means that the electromagnetic field experienced by the superconductor is weak as understood from Biot Savart's Law, and this phenomenon produces a desirable effect on the superconductivity limit. Therefore, the stability of the superconductivity of the coil is easily maintained, and the cross sectional area of the superconductor in the central region of the superconducting solenoid coil can be significantly decreased, enabling a high stability and economy of the superconducting solenoid coil to be obtained. Also, the cooling of the superconductor solenoid coil can be easily effected.

Figure 4:
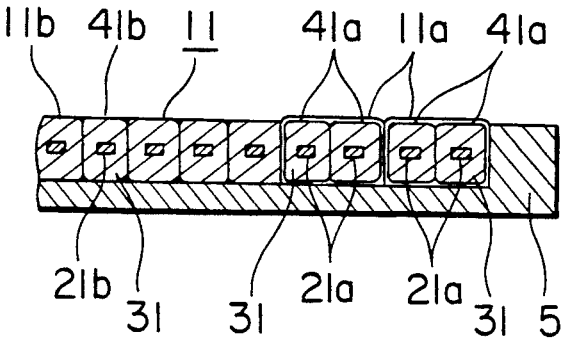
FIGS. 4 and 5 are enlarged sectional side views of other embodiments of a superconducting apparatus of the present invention.
Figure 5:
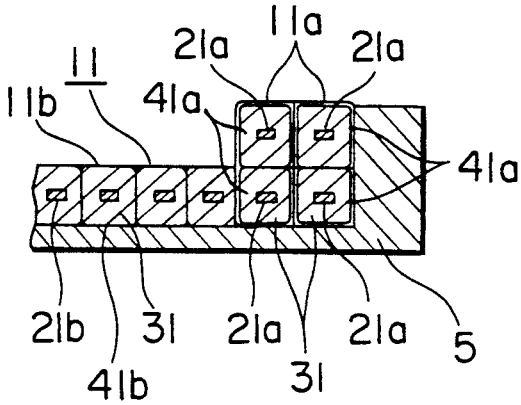

As an alternative means for increasing the cross-sectional area of the superconducting wire 41*a*, it is possible to use the superconducting wires 41*a* of two or more turns connected in parallel as shown in FIG. 4 to effectively increase the cross-sectional area of the superconductor 21*a*. Also, as shown in FIG. 5, the superconducting wires 41*a* may be placed one on the other in the radial direction or the wires may be connected in parallel to effectively increase the cross-sectional area of the superconductor 21*a*. These alternative arrangements provide advantages similar to those provided by the previous embodiment.

As has been described, according to the present invention, a superconductor of the superconducting wire has a larger sectional area at the end region of the superconducting solenoid coil than at the central region, thereby lowering the current density, so that the temperature increase due to the magnetic field is suppressed, resulting in highly stable superconductivity.

What is claimed is:

1. A superconducting solenoid coil including a bobbin having at least one end and a central region and a single layer of windings of a superconducting wire wound around said bobbin from said end at least to said central region, said superconducting wire comprising a superconducting material having a rectangular cross-sectional area with a narrow width and a stabilizing material surrounding said superconducting material wherein said superconducting material surrounded by said stabilizing material has a larger cross-sectional area at the end of said bobbin than at the central region of said bobbin.

2. The superconducting solenoid coil as claimed in claim 1 wherein said superconducting wire is wound around said bobbin in a plurality of turns and the cross-sectional area of said superconducting material of each of said superconducting wires in two turns at the end of said bobbin is larger than the cross-sectional area of said superconducting material of each of said superconducting wires in the turns in the central region of said bobbin.

3. A superconducting solenoid coil including a bobbin having at least one end and a central region and single layer of a superconducting wire wound around said bobbin from said end to at least said central region in a plurality of turns, said superconducting wire comprising a superconducting material having a rectangular cross-sectional area with a narrow width and a stabilizing material in which said superconducting material is embedded wherein at least two of the turns of said single layer of superconducting wire at the end region of said bobbin are electrically connected to each other in parallel whereby the effective cross-sectional area of said superconducting material for the flow of an electrical current through said solenoid coil at the end of said bobbin is increased relative to the effective cross-sectional area of said superconducting material at the central region of said bobbin.

4. The superconducting solenoid coil of claim 3 wherein each of two wires in at least two pairs of the turns of said superconducting wire at the end of said bobbin are electrically connected to each other in parallel.

5. A superconducting solenoid coil including a bobbin having at least one end and a central region, a single layer of a superconducting wire wound around said bobbin from said end to at least said central region in a plurality of turns, and a first additional turn of said superconducting wire at the end of said bobbin wound on a first of the turns of said single layer of superconducting wire and electrically connected in parallel to said first turn, wherein said superconducting wire comprises a superconducting material having a rectangular cross-sectional area with a narrow width and a stabilizing material in which said superconducting material is embedded whereby the parallel connection of said first turn and said first additional turn increases the effective cross-sectional area of said superconducting material for the flow of an electrical current through said solenoid at the end of the bobbin relative to the effective cross-sectional area of said superconducting material at the central region of said bobbin.

6. The superconducting solenoid coil of claim 5 including a second additional turn of said superconducting wire at the end of said bobbin wound on a second of the turns of said single layer of superconducting wire and electrically connected in parallel to said second turn.

* * * * *